US007654430B2

(12) United States Patent
Cho et al.

(10) Patent No.: US 7,654,430 B2
(45) Date of Patent: Feb. 2, 2010

(54) COIL NAILING DEVICE FOR CONSTRUCTION FINISHING MATERIALS

(75) Inventors: Bo-Seob Cho, Seoul (KR); Gil-Sub Song, Incheon (KR); Jae Sung Kim, Seoul (KR); In Sung Hwang, Incheon (KR); Myung-Kyun Kim, Seoul (KR); Sang Chun Lee, Seongnam-Si (KR); Jong-Yeol Han, Seongnam-Si (KR)

(73) Assignee: Jeil Tacker Co. Ltd., Gwangju-Si, Gyeonggi-Do (KR)

( * ) Notice: Subject to any disclaimer, the term of this patent is extended or adjusted under 35 U.S.C. 154(b) by 0 days.

(21) Appl. No.: 12/007,402

(22) Filed: Jan. 10, 2008

(65) Prior Publication Data

US 2008/0110956 A1 May 15, 2008

Related U.S. Application Data

(63) Continuation of application No. 11/255,294, filed on Oct. 20, 2005, now abandoned.

(51) Int. Cl.
*B25C 1/04* (2006.01)

(52) U.S. Cl. ..... 227/109; 227/128; 227/130; 227/135; 227/137

(58) Field of Classification Search ..... 227/151, 227/128, 137, 109, 135, 120
See application file for complete search history.

(56) References Cited

U.S. PATENT DOCUMENTS 2,472,032 A * 5/1949 Wandel ..... 227/123
3,330,462 A * 7/1967 Colechia et al. ..... 227/136
3,568,908 A * 3/1971 Bader ..... 227/127
3,703,981 A * 11/1972 Smith ..... 227/136
3,708,097 A * 1/1973 Fisher ..... 227/136
3,945,551 A * 3/1976 Sato et al. ..... 227/136
4,139,137 A * 2/1979 Gupta ..... 227/123
4,200,215 A * 4/1980 Novak et al. ..... 227/123
4,433,782 A * 2/1984 Figge et al. ..... 206/338
4,518,109 A * 5/1985 Shiroyama ..... 227/109
4,585,154 A * 4/1986 Fealey et al. ..... 227/109
4,600,135 A * 7/1986 Mukoyama ..... 227/120
4,688,710 A * 8/1987 Massari et al. ..... 227/109
4,767,043 A * 8/1988 Canlas, Jr. ..... 227/8
4,784,308 A * 11/1988 Novak et al. ..... 227/130
4,903,880 A * 2/1990 Austin et al. ..... 227/8

(Continued)

*Primary Examiner*—Rinaldi I. Rada
*Assistant Examiner*—Lindsay Low
(74) *Attorney, Agent, or Firm*—GWiPS

(57) ABSTRACT

A coil nailing device for finishing materials is invented that comprises a standby part for temporarily retaining and loading the nails into a muzzle. A door is installed adjacent to the standby part to check the nail supply. A door latch consists of a hook, coil spring and latch hinge shaft. The door and door latch are operated in the lateral direction, perpendicular to the axis of the main body. The muzzle consists of an adapter, lever arm and a pair of arc-shaped sliding grooves formed on both lateral surfaces. The adapter is attachable to the nose of the main body. A clearance setting device is designed to allow the use of various sizes of nails by setting the depth of the magazine depending on the loaded nail size. An interval setting device is convenient to nail a series of shingle panels by setting the panel interval while the coil nailing device is sliding along the edge of the panels.

7 Claims, 9 Drawing Sheets

U.S. PATENT DOCUMENTS 4,942,996 A * 7/1990 Wolfberg et al. ..... 227/136
5,012,709 A * 5/1991 Su ..... 81/466
5,261,587 A * 11/1993 Robinson ..... 227/8
5,261,588 A * 11/1993 Lin ..... 227/110
5,263,908 A * 11/1993 Chen ..... 482/44
5,267,682 A * 12/1993 Okouchi ..... 227/151
5,268,445 A * 12/1993 Gaymans et al. ..... 528/272
5,634,582 A * 6/1997 Morrison et al. ..... 227/109
5,683,024 A * 11/1997 Eminger et al. ..... 227/8
5,733,089 A * 3/1998 Albright ..... 414/226.02
5,799,856 A * 9/1998 Mukoyama ..... 112/112
5,842,625 A * 12/1998 Kimura ..... 227/127
6,152,346 A * 11/2000 Laubach ..... 227/109
6,386,471 B1 * 5/2002 Keller et al. ..... 242/347
6,454,151 B1 * 9/2002 Wang-Kuan ..... 227/8
6,543,496 B2 * 4/2003 Woodruff ..... 141/346
6,672,497 B2 * 1/2004 Lin ..... 227/8
6,948,647 B1 * 9/2005 Niblett et al. ..... 227/130
7,055,728 B2 * 6/2006 Lin ..... 227/110
7,137,186 B2 * 11/2006 Wojcicki et al. ..... 29/592
7,175,063 B2 * 2/2007 Osuga et al. ..... 227/8
7,234,623 B2 * 6/2007 Li ..... 227/137

* cited by examiner

COIL NAILING DEVICE FOR CONSTRUCTION FINISHING MATERIALS

This is a Continuation of Ser. No. 11/255,294, filed Oct. 20, 2005, now abandoned.

BACKGROUND OF THE INVENTION

1. Field of the Invention

The present invention relates to a coil nailing device, and more particularly, to the coil nailing device having a door latch that releases in the same direction as the door opening and closing direction so that the door is released by one touch of the door latch with a finger, an attachable adapter for easily attaching or removing the nose to/from the main body, a clearance setting means for loading various sizes of nails by setting the depth of the magazine depending on the loaded nail size, and an interval setting means for conveniently nailing a series of shingle panels by setting the panel interval for sliding along the edge of the shingle panels.

2. Description of the Related Prior Art

As is well-known, a tacker, used in constructing buildings and in interior construction, is a pneumatic device, such as a nailer, a stapler, or a pinner that is used in joining wood to wood, wood to plastic, wood to steel, and wood to concrete, and is used in various constructions such as interior and exterior decoration of buildings, installation of aluminum sashes, or the like.

General working principles of the tackers are almost identical to each other, but structures of the nailer, the stapler, and the pinner are slightly different from each other.

A general coil nailer 2, as shown in FIG. 1, includes a body 4 in which a piston and a cylinder are installed, a handle 6 installed to the lower side of the body 4 and grasped by a hand and having a supply passage for supplying air to the piston, a magazine 10, installed to the front lower side of the body 4, in which nails, staples, or pins are contained, and a standby part 12 for receiving the nails, staples, or the pins loaded in the magazine 10 and for positioning the nails, the staples, or the pins for firing through a muzzle 14 positioned at the front side of the body 4.

Moreover, the coil nailer 2 further includes a door 16 installed at the lower side of the front standby part 12 of the body 4 that can be opened to visually check the nails, the staples, or the pins supplied from the magazine 10, a door latch 20 for keeping the door 16 closed, and a hinge shaft 18 coupled with a lateral side of the front muzzle 14 of the body 4 by a shaft to open the door 16.

As such, according to the conventional coil nailer, since a plurality of nails (not shown) is welded in the magazine 10 by a coil and is supplied to the muzzle 14, a worker must open the door 16 using the door latch 20, in order to check the state of the nails loaded therein.

However, in the conventional coil nailer, since the door latch 20 of the nailer has a structure wherein the door 16 is opened when the worker grasps the handle with the right hand, holds the door latch 20 with a right thumb and a right forefinger, and lifts the door latch 20 up while pushing the door latch 20 toward the muzzle 14, the direction of opening the door 16 is different from the direction of releasing the door 16 using the door latch 20.

In other words, since the door 16 opens only when the worker of the conventional coil nailer pushes the door latch 20 to the front side to release the door latch 20, and lifts the door latch 20 up, two different actions must be simultaneously carried out to open the door 16. In addition, since the releasing direction of the door latch 20 is aligned with the direction of the muzzle 14, recoil may cause the door latch 20 to be released.

Moreover, since the internal structure of the magazine 10 of the conventional coil nailer 2 can only accommodate nails having a predetermined length, in order to use other nails having a different length, the worker must use another coil nailer 2 to accommodate the other nails. In the case of loading and using smaller nails than those for which the magazine 10 was designed, the nails lifted from the inside of the magazine 10 to the front standby part 12 cannot be smoothly guided.

Additionally, the conventional coil nailer 2 is used in finish work such as shingling. Shingling is the process of attaching partially laminated waterproof sheets on a sloped outer surface of a roof at predetermined intervals.

Until today, shingling has been carried out in the following manner. First, the worker holds a measuring device such as a scale with one hand and measures the interval between a lower waterproof sheet and an upper waterproof sheet to which a part of the upper side of the lower waterproof sheet is attached so as to precisely attach any one sheet in the horizontal direction.

However, in shingling carried out in the above-mentioned way, since the typical worker holds the coil nailer 2 with one hand and holds the measuring device with the other hand, nailing is carried out using only one hand. Thus, the conventional coil nailer is difficult to use and the worker may fail to hold the coil nailer 2 with one hand and may drop the coil nailer 2. Particularly, when dropping the coil nailer 2 during roofing work using a conventional coil nailer 2, there is a high risk of injury to other workers.

Meanwhile, the conventional coil nailer 2 includes a contact arm installed in the longitudinal direction of the body 4 and a contactor contacting an actual striking spot installed in the front side thereof, wherein the contact arm and the contactor are coupled by bolts and welding.

However, since the contactor employed in the conventional coil nailer 2 contacts the striking spot so frequently that the front side thereof is easily worn, the bolts must be released and the welded spots must be separated during the replacement of the contactor after use for a predetermined period of time. Thus, replacement of the contactor is complicated.

SUMMARY OF THE INVENTION

Therefore, the coil nailing device of the present invention includes improvements to solve the above problems.

An objective of the present invention is to provide a coil nailing device in which the door latch releases in the same direction as the opening and closing direction of the door, so that the door is released by merely pushing the door latch. The releasing direction of the door latch is perpendicular to the recoiling direction of the coil nailing device to prevent accidental opening of the door due to the recoil force.

It is another objective of the present invention to provide a coil nailing device in which an adapter is easily engaged with or disengaged from the nose of the main body by lifting the lever arm.

It is still another objective of the present invention to provide a coil nailing device in which a clearance setting means sets the container depth of the cylindrical magazine for loading various sizes of nails or staples, so that various sized nails or staples can be properly loaded into the container of the cylindrical magazine and can be properly guided and supplied to the muzzle. For nailing a series of shingle panels, an interval setting means sets a panel width or interval between neighboring shingle panels so that the coil nailing device can be easily maneuvered for nailing or stapling on the correct spots of the shingle panels while sliding along the edge of the shingle panels.

In accordance with the present invention, the aforementioned objects can be accomplished by the provision of a coil nailing device for construction finishing materials consisting of a main body enclosing a set of pneumatic mechanisms for striking nails, a nose located in front of the main body for ejecting the nails, a handle grip, a trigger and a cylindrical magazine for supplying the nails or staples, the coil nailing device further comprising: a standby part for temporarily retaining and loading the nails or staples that are supplied from the cylindrical magazine, a door installed adjacent to the standby part for checking the status of the nails or staples, the door hinged by a door shaft, a door latch consisting of a hook, a coil spring and a latch hinge shaft, the door latch hinged by the latch hinge shaft and installed at the opposite end of the door from the door shaft for locking the door, a muzzle consisting of an adapter, a lever arm and a pair of arc-shaped sliding grooves formed on both lateral surfaces of the adapter, the adapter for easily attaching or removing the nose to/from the main body, a clearance setting means for loading various sizes of nails or staples by setting the container depth of the cylindrical magazine (110), so that various sized nails or staples can be properly loaded into the container of the cylindrical magazine (110) for properly guiding and supplying to the muzzle (114), and an interval setting device for nailing the series of shingle panels by setting a panel width or interval between neighboring shingle panels, so that the coil nailing device can be easily maneuvered for nailing or stapling on the correct spots of the shingle panels while sliding along the side edge of the shingle panels.

DESCRIPTION OF THE PREFERRED EMBODIMENTS

Hereinafter, a coil nailer according to the preferred embodiment of the present invention will be described with reference to the accompanying drawings.

Figure 1:
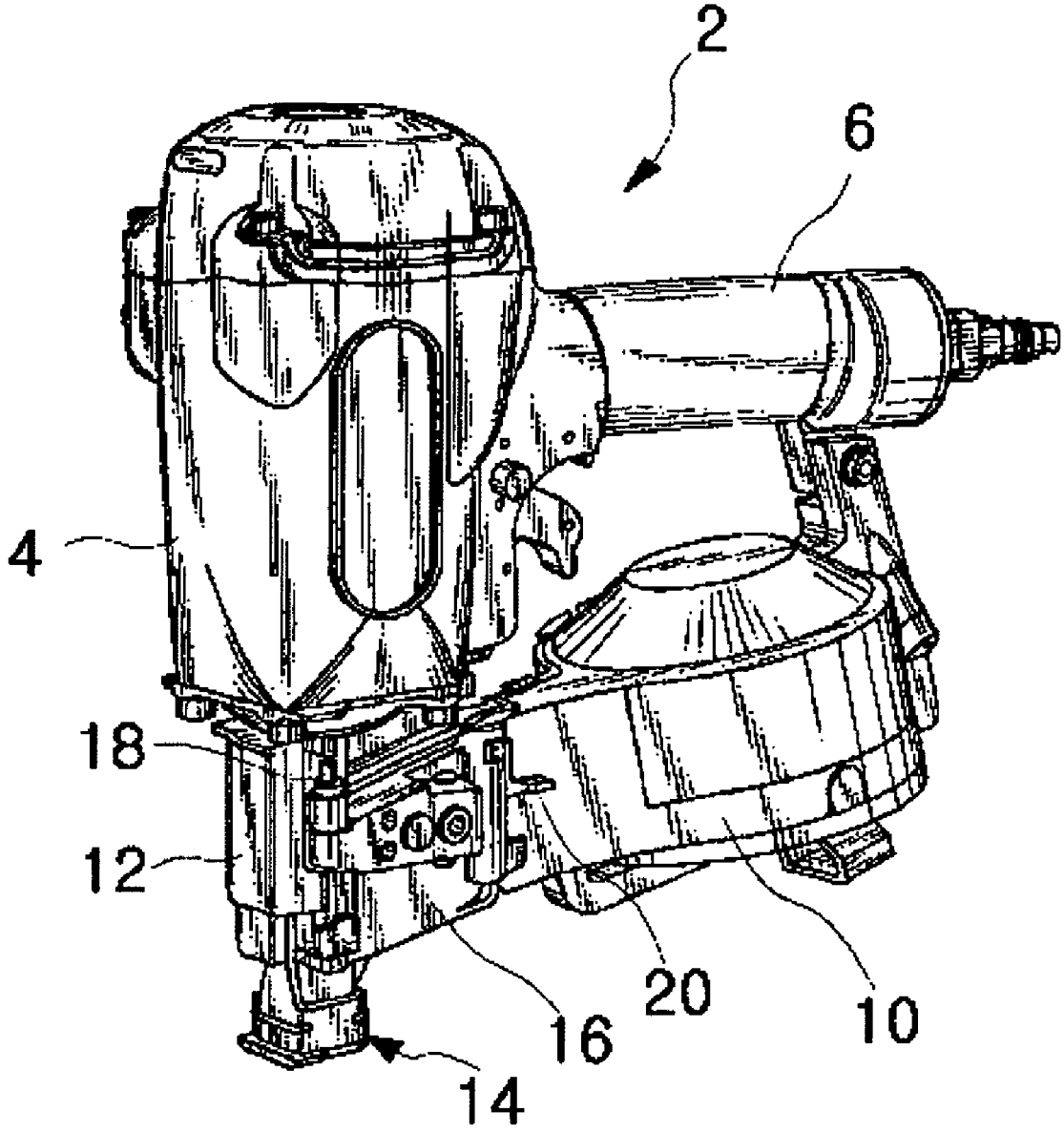
Fig. 1 (Prior Art)
FIG. 1 is a perspective view illustrating a conventional coil nailer.
Figure 2:
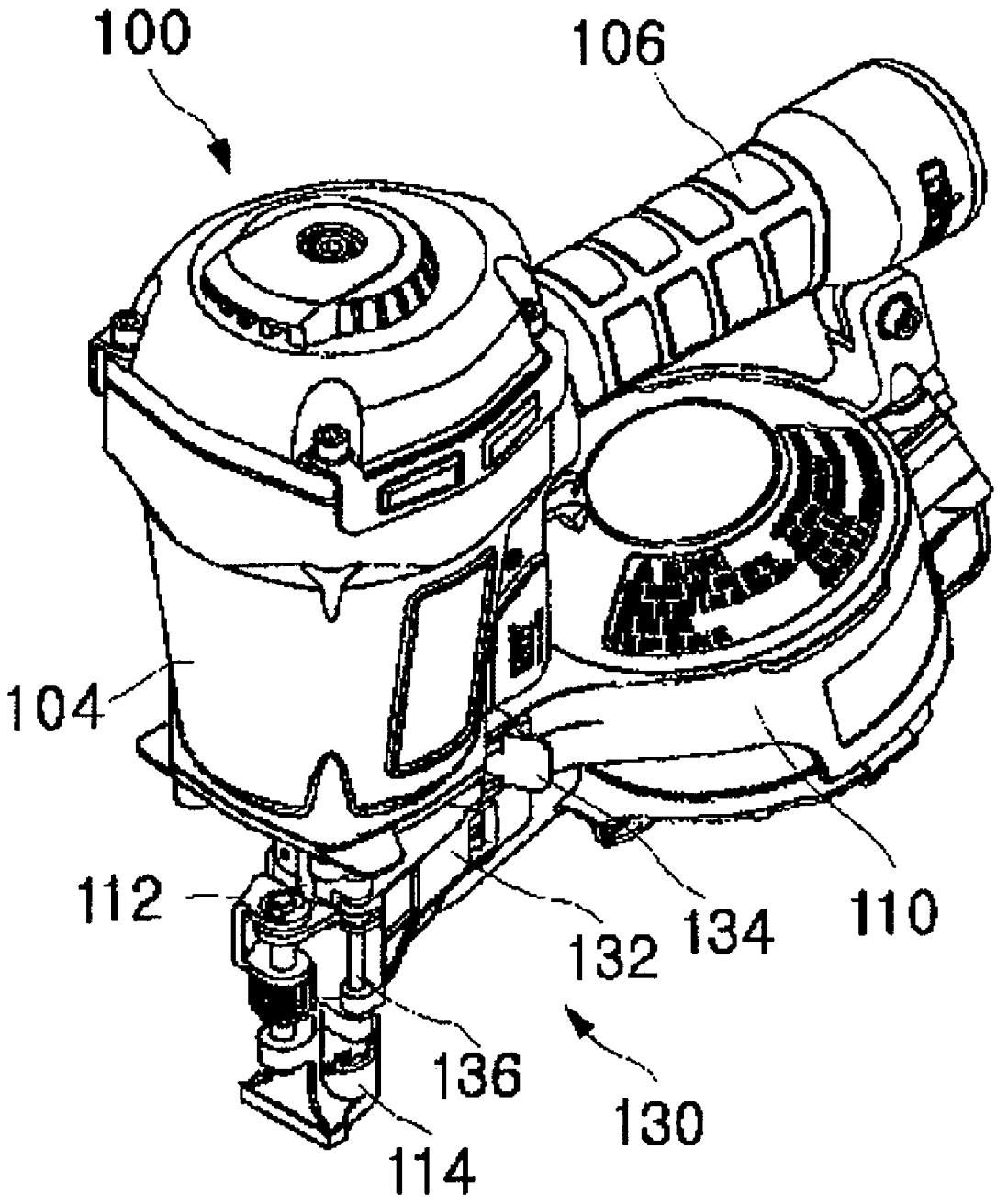
FIG. 2 is a perspective view illustrating a coil nailer according to a preferred embodiment of the present invention.
Figure 3:
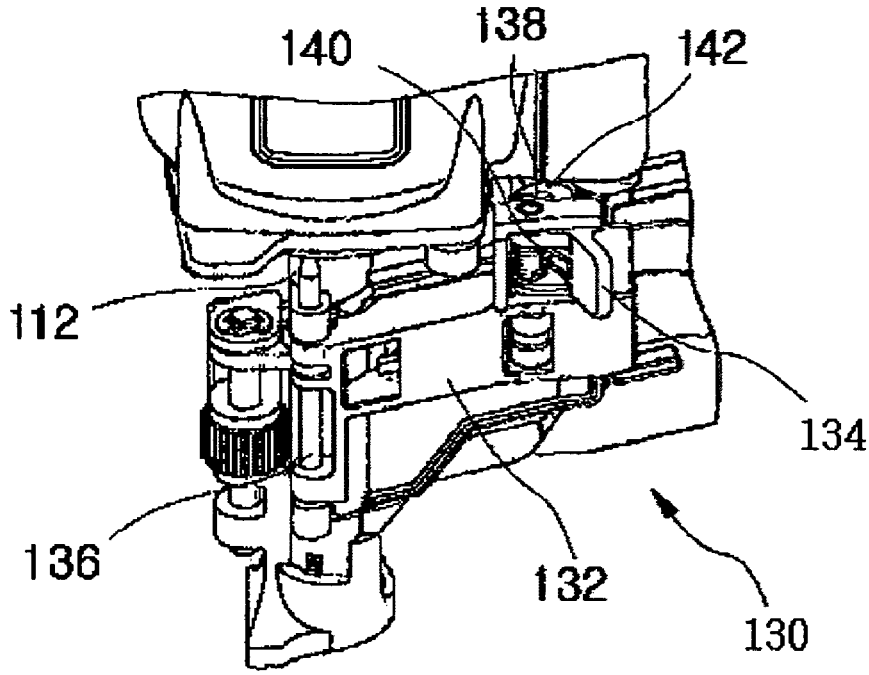
FIG. 3 is a detailed partial perspective view illustrating a door latch of the coil nailer according to the preferred embodiment of the present invention.
Figure 4:
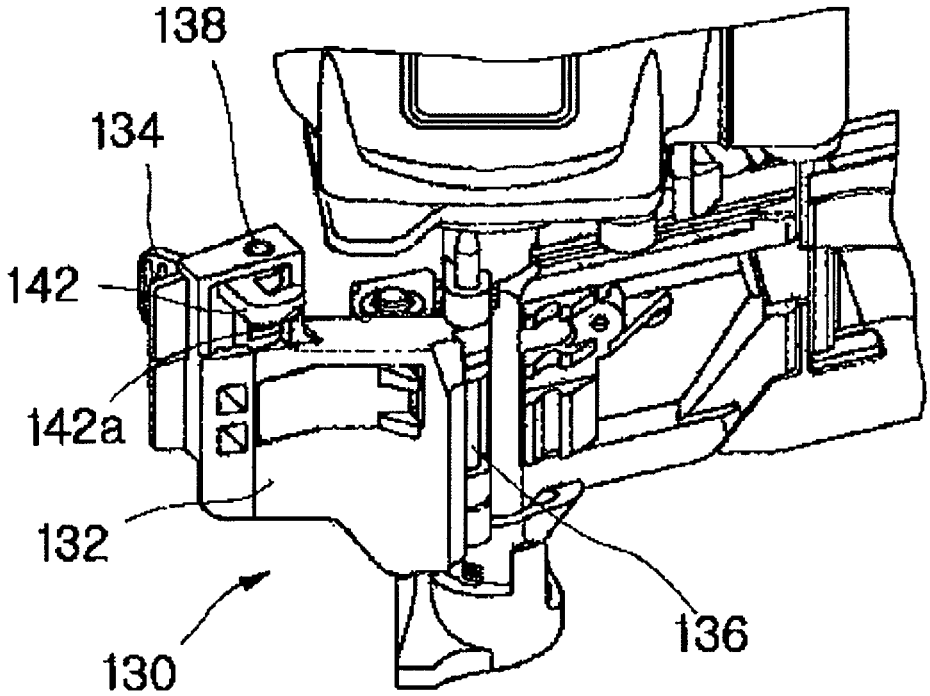
FIG. 4 is a perspective rear-side view illustrating the rear side of the door of the coil nailer according to the preferred embodiment of the present invention.

FIG. 2 is a perspective view illustrating a coil nailer according to the preferred embodiment of the present invention, FIG. 3 is a detailed partial perspective view illustrating a door latch of the coil nailer according to the preferred embodiment of the present invention, and FIG. 4 is a perspective rear-side view illustrating the rear side of the door of the coil nailer according to the preferred embodiment of the present invention.

As shown in the above respective drawings, the coil nailing device 100 of the present invention has a structure comprising a door latch that releases in a direction that is aligned with the opening and closing direction of the door so that the door is released by unlatching of the door latch perpendicular to the recoiling direction of the coil nailing device. Therefore, the door is prevented from accidental opening due to recoil.

Accordingly, the coil nailing device 100 of the present invention is structured such that a door 132 is opened and closed in the lateral direction, and a door latch 134 installed on the top corner of the door 132 operates in the same direction as the door 132.

Further, the door latch (134) comprises a coil spring (140) mounted on the latch hinge shaft (138) for exerting a resilient force on the door latch (134), so that the door (132) is prevented from accidental opening due to the repulsive force of a firing.

When the door latch 134 is pushed laterally, a hook 142 formed on the inside of the door latch 134 is released from a locking bar.

Thus, when the worker grasps the handle 106 of the nailing device 100 with the right hand and pushes the door latch 134 provided on the left front side of a body 104 laterally with a finger, as shown in FIG. 4, the hook 142 formed on the inside of the door latch 134 is released from the locking bar to open the door 132.

To close the door, the worker grasps the handle 106 of the coil nailing device 100 with the right hand and closes the door 132 until the hook 142 of the door latch 134 is engaged to the locking bar.

At this moment, when the worker presses the door 132 or the door latch 134 toward the body 104 with his finger, the hook 142 formed on the inside of the door latch 134 is locked by the locking bar.

The door latch 134 is mounted by the hinge shaft 138 at the corner of the door 132, and both ends of a restoring spring 140 are respectively connected to the latch hinge shaft 138 and the door latch 134.

Moreover, the tip 142*a* of the hook 142 is tapered, so that the hook 142 snaps onto the locking bar to engage it.

Meanwhile, the door latch 134 must be disengaged from the locking bar to open the door 132. The door latch has a structure intended to prevent the accidental opening of the door 132 due to the repulsive forces when the coil nailing gun 100 is fired.

When the coil nailing device 100 fires nails positioned in the muzzle, the repulsive reaction is oriented along the longitudinal direction of the main body 104, and the bouncing forces are propagated to the direction of the muzzle 114.

However, the operation direction of the door latch 134 is lateral, which is perpendicular to the recoiling direction of the main body, so that the door latch 134 is not easily released due to recoil.

The door latch structure of the present invention is designed to prevent the accidental opening of the door, which occurs frequently due to the impacting forces.

Figure 5:
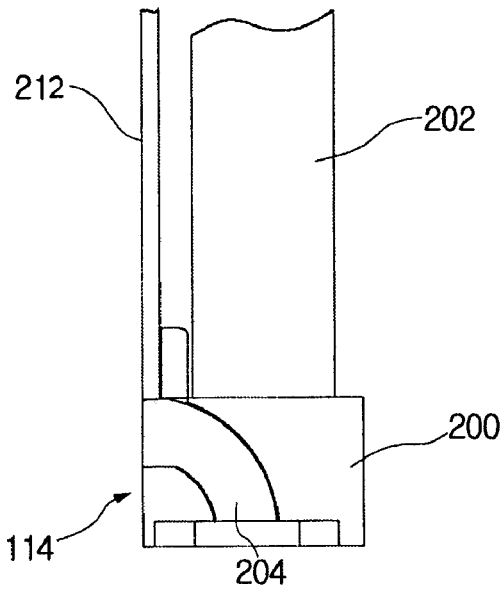
FIG. 5 is a view illustrating the coupling structure of a connector of the coil nailer according to the preferred embodiment of the present invention.
Figure 6:
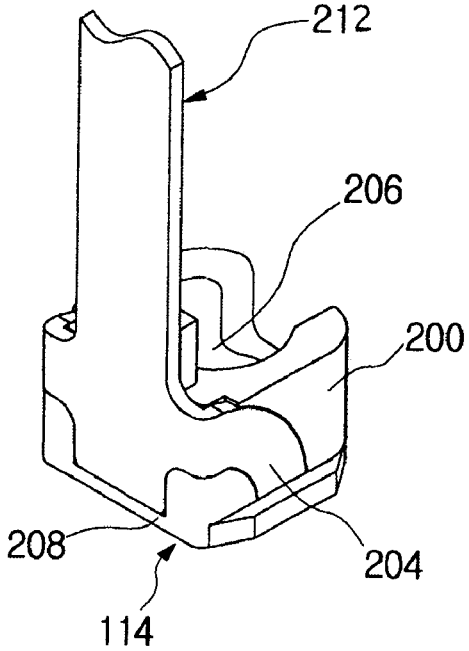
FIG. 6 is a perspective view illustrating the coupling structure of the connector of the coil nailer according to the preferred embodiment of the present invention.
Figure 7:
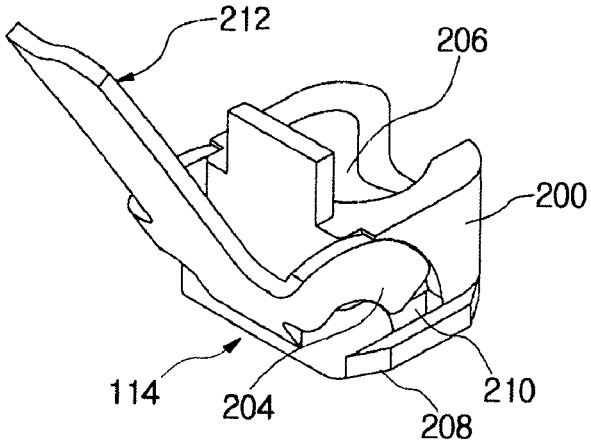
FIG. 7 is a perspective view illustrating operation of the connector of the coil nailer according to the preferred embodiment of the present invention.

FIG. 5 is a view illustrating a muzzle and adapter structure of the coil nailing device according to the preferred embodiment of the present invention, FIG. 6 is a perspective view illustrating the muzzle and adapter structure of the coil nailing device according to the preferred embodiment of the present invention, and FIG. 7 is a perspective view illustrating operation of the lever arm of the coil nailing device according to the preferred embodiment of the present invention.

The muzzle 114 of the present invention will now be described with reference to the above mentioned drawings. The muzzle (114) consists of an adapter (200), a lever arm (212) and a pair of arc-shaped grooves (210) oppositely formed on both lateral surfaces of the adapter (200), wherein the adapter (200) allows to be easily attached to or removed from the nose (202) of the main body (104).

The adapter of the present invention can be attached to the nose 202, and a lever arm 212 is installed adjacent to the adapter 200, which is positioned upright in the longitudinal direction for attaching to the nose 202, which is the coupling position.

As seen in FIG. 7, the adapter 200 forms a cubic-shaped block with an inner cavity 206 for inserting the nose 202, a foot plate 208 for contacting a work piece and a pair of arced grooves 210 disposed oppositely on its outer lateral surfaces. The lever arm 212 has a flat bar-shaped handle integrally attached perpendicular to a pair of arced sliders 204 with a quarter circular sectors at the bottom end portion of the handle for rotationally sliding along with the arced grooves 210.

Thus, according to the present invention, the lever arm 212 and the adapter 200 are easily engaged to or disengaged from the nose, or from one another. The structure of the adapter 200 and lever arm 212 are designed to easily and firmly attach to or separate from the nose 202 of the main body 104 by pulling the lever arm 212 up or down and to remain firmly installed against the repulsive reactions during a firing.

The proximal end of the lever arm 212 is integrally connected to the arced sliders 204 to slide along the sliding grooves 210.

Thus, according to the present invention, when the lever arm 212 is lifted up to the coupling position, the lever arm 212 and the adapter 200 are engaged to the nose of the main body. It is possible to easily replace the adapter 200 when the adapter 200 is worn out.

Figure 8:
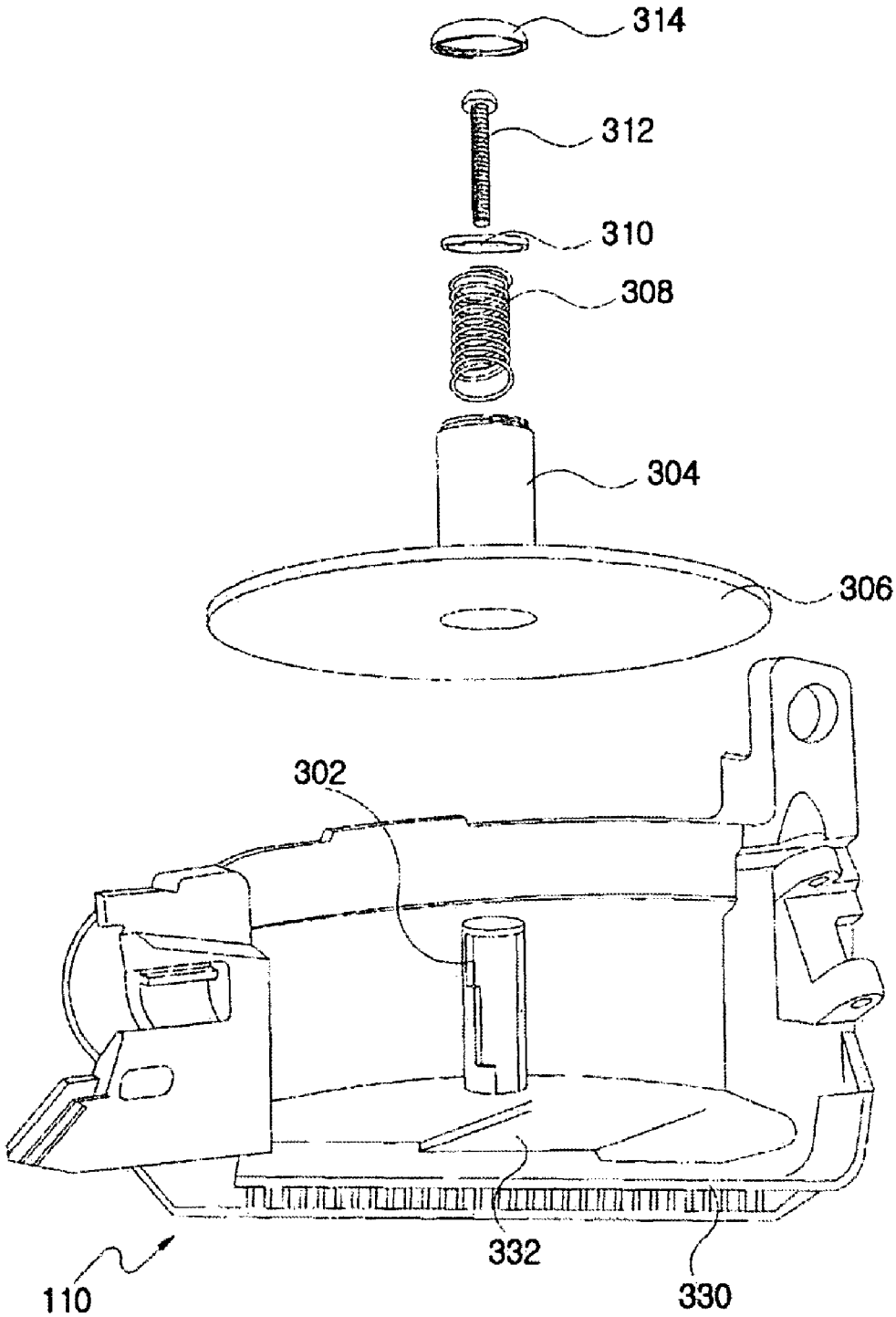
FIG. 8 is an exploded perspective view illustrating a magazine of the coil nailer according to the preferred embodiment of the present invention.

FIG. 8 is an exploded perspective view illustrating the magazine of the coil nailing device according to the preferred embodiment of the present invention.

Referring to the above drawing, the magazine 110 of the present invention has a clearance setting device to properly guide the nails by moving a guiding device in the magazine according to the size of the loaded nails. It also has an interval setting device installed under the bottom of the magazine 110 to set the panel intervals between shingles, so that the coil nailing device can precisely nail on the correct spots on the panels and can be easily maneuvering with both hands because a separate measuring device is not needed.

The clearance adjusting device comprises a disk plate (306) for controlling the clearance or depth of the cylindrical magazine (110), a sleeve (304) integrally mounted to the center of the disk plate (306), a central post (302) having a cylindrical shape integrally formed at an inner center of the cylindrical magazine (110), wherein the central post (302) includes first, second and third stepped grooves on its outer circumference for setting the clearance or depth depending on the length of loaded nails or staples.

Referring to FIG. 8, the depth adjustor for the magazine 110 of the coil nailing device according to the preferred embodiment of the present invention will now described.

The magazine 110 of the coil nailing device 100 of the present invention has a cylindrical drum shape, so that the coil of nails is wound to form concentric circles including a winding shaft of the coil as a central post 302 installed at the inner center of the magazine 110.

The central post 302 has a plurality of stepped grooves in the outer circumference and a sleeve 304 is integrally installed on the disk plate (306).

The sleeve 304 has a tubular shape for inserting the central post 302 and supporting the disk plate 306. The disk plate 306 is integrally mounted to the sleeve 304.

In the tubular sleeve 304, a spring 308 is installed for exerting a resilient force toward the bottom surface of the magazine 110. On the upper side of the sleeve 304, a washer 310 is installed so that the resilient force of the spring 308 is transmitted to a fixed bolt 312.

A long bolt 312 is inserted through the tubular sleeve 304 for suspending the disk plate 306 on the central post (302). The central post 302 includes three different stepped grooves to support the sleeve 304. A cap 314 is provided for closing the top of the sleeve 304.

According to the present invention, when the sleeve 304 is fixed to the central post 302, the sleeve 304 is lifted from the bottom of the magazine 110 by a predetermined height for setting the depth of the container or height of the magazine according to the length of the loaded nails. Thus, a plurality of coiled nails is loaded on the inner bottom of the magazine 110. The height of the sleeve 304 is manually adjusted according to the length of the nails.

Figure 9:
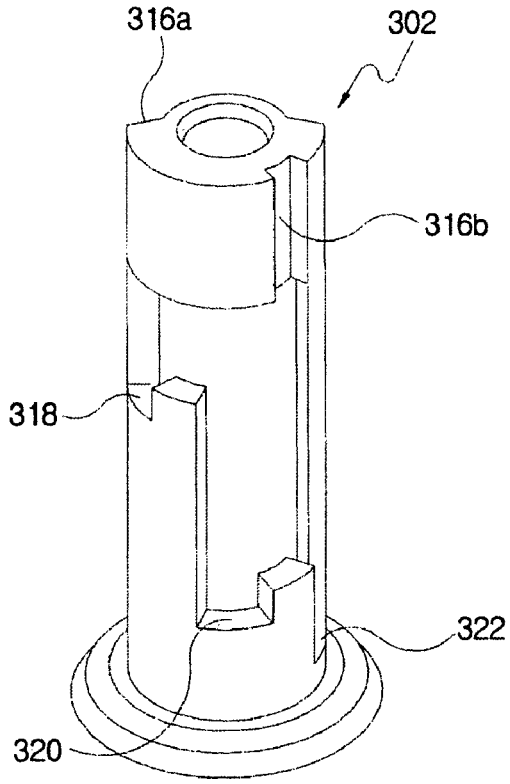
FIG. 9 is a partially enlarged perspective view illustrating a magazine post of the coil nailer according to the preferred embodiment of the present invention.
Figure 10:
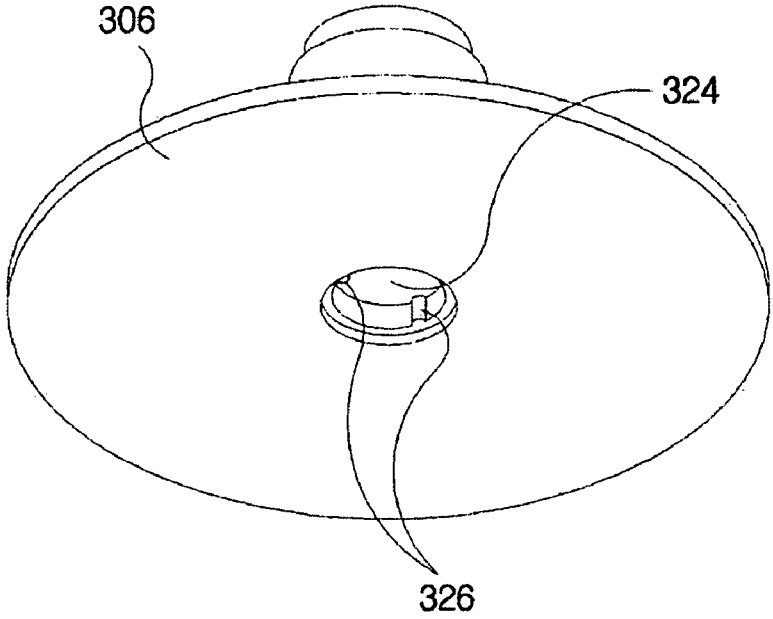
FIG. 10 is a bottom perspective view illustrating a coil supporting plate of the coil nailer according to the preferred embodiment of the present invention.
Figure 11:
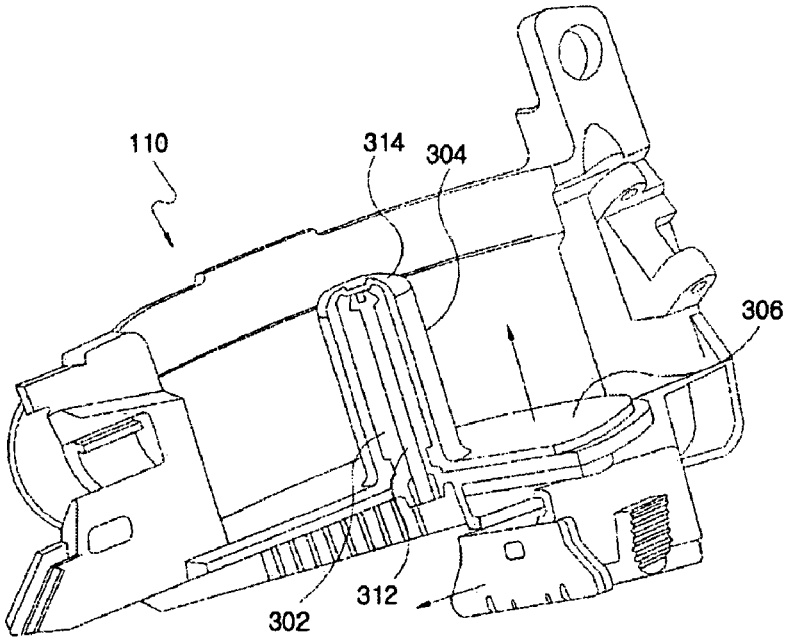
FIG. 11 is a partially cut away perspective view illustrating a magazine of the coil nailer according to the preferred embodiment of the present invention.

FIG. 9 is an enlarged perspective view illustrating the central post of the magazine according to the preferred embodiment of the present invention, FIG. 10 is a bottom perspective view illustrating the coil supporting plate of the coil nailing device according to the preferred embodiment of the present invention, and FIG. 11 is a partially cut away perspective view illustrating the magazine of the coil nailing device according to the preferred embodiment of the present invention.

As shown in the drawings, the central post 302 is a device for fixing the bottom of the magazine 110 and adjusting the height of the sleeve 304. The central post 302 has a tubular shape for the bolt 312 to pass through. A plurality of guide grooves 316*a* and 316*b* are formed on the outer circumference along the longitudinal direction, while a first stepped groove 318, a second stepped groove 320, and a third stepped groove 322 having flat stepped surfaces are formed on the guide grooves 316*a* and 316*b* with different heights.

The first stepped groove 318 is located at the highest position along the guide grooves 316*a* and 316*b*, the third stepped groove 322 is located at the lowest position along the guide grooves 316*a* and 316*b*, and the second stepped groove 320 is located between the first stepped groove 318 and the third stepped groove 322.

The sleeve (304) further comprises a spring (308) for exerting a resilient force on the disk plate (306), a fastener bolt (312) for fastening the disk plate (306) onto the bottom of the cylindrical magazine (110), a seal (310) and a cap (314) for securing the disk plate (306), and a pair of knots (326) at the proximal end of its inner surface to be seated on either one of the first, second or third stepped grooves of the central post (302).

Thus, according to the present invention, as shown in FIG. 11, when a set of coiled nails is loaded on the upper side of the disk plate 306 and the sleeve 304 is lifted, the resilient force pushes the sleeve 304 toward the bottom of the magazine 110 due to the elastic force of the spring 308 in the sleeve 304.

The worker overcomes the force and rotates the sleeve 304 to a proper position in the horizontal direction, then a pair of knots 326 is seated on either the first, second, or third stepped grooves 318, 320, or 322.

At this point, the external force applied to the sleeve 304 by the worker is released, as soon as the knots 326 of the sleeve 304 are placed on the stepped groove 320.

Figure 12:
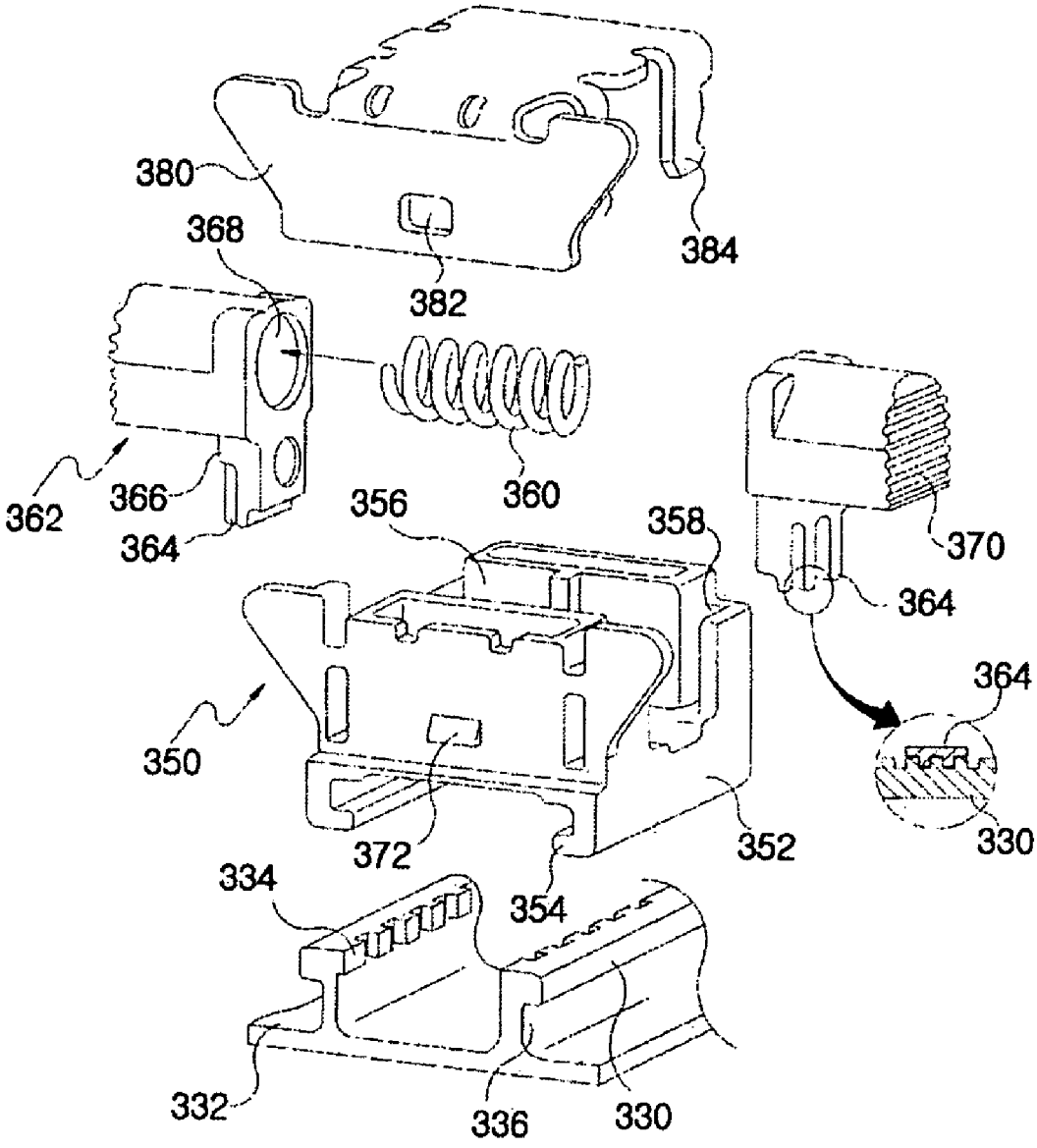
FIG. 12 is an exploded perspective view illustrating a shingle-interval adjusting device of the coil nailer according to the preferred embodiment of the present invention.
Figure 13A:
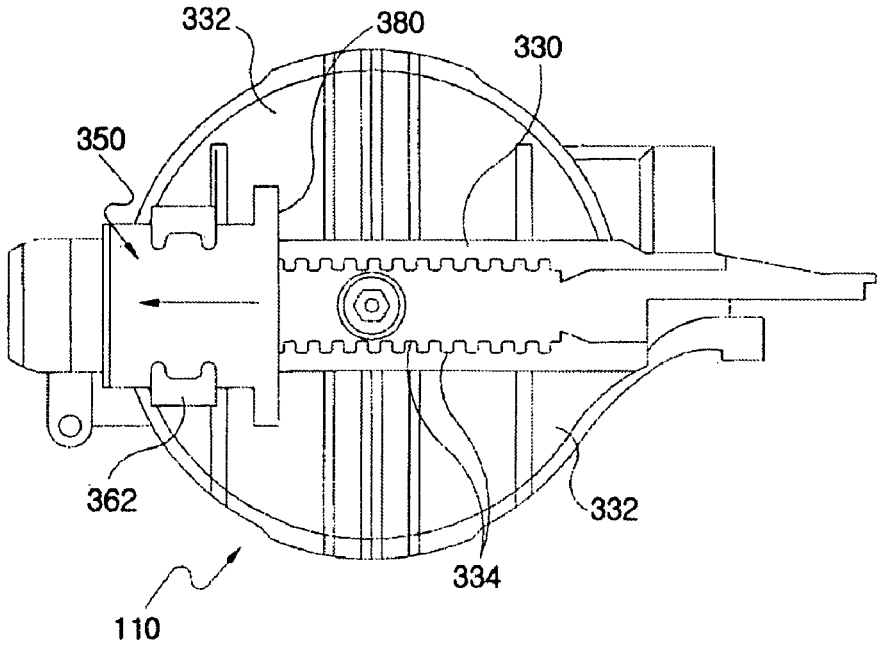
FIGS. 13*a* and 13*b* are views illustrating the use of the shingle-interval adjusting device of the coil nailer according to the present invention.
Figure 13B:
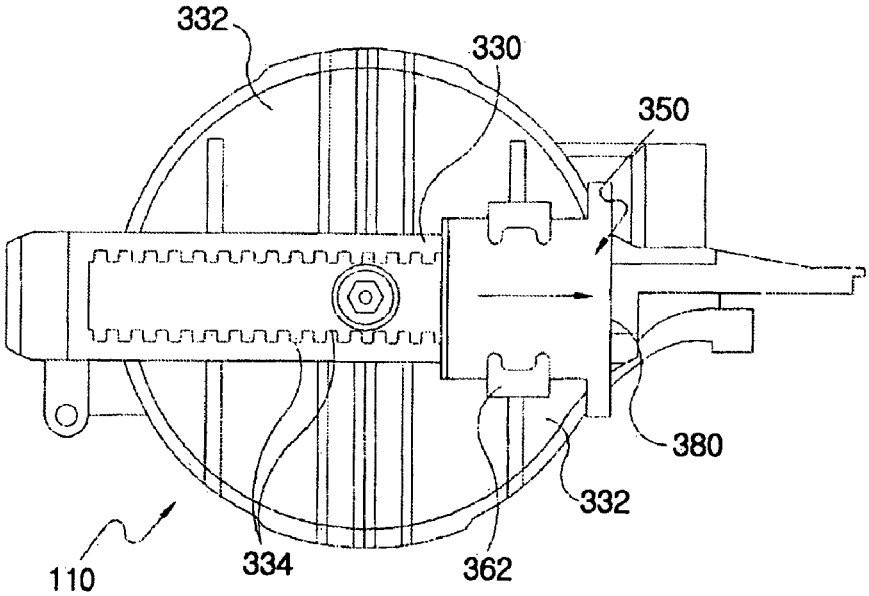

FIGS. 12, 13*a*, and 13*b* are an exploded perspective view illustrating the shingle-interval setting device of the coil nailing device according to the preferred embodiment of the present invention, and views illustrating the use of the shingle setting device of the coil nailing device according to the present invention.

Referring to the drawings, the shingle interval setting device, which is mounted underneath the coil nailing device 100, is used for setting the intervals between shingles.

The interval setting device comprises a base (332) including an integrally formed pair of guiding rails (330) having rack gears (334) and recessed lateral surfaces (336) for mounting at the bottom of the cylindrical magazine (110) and a sliding block (350) for engaging to the guide rails (330).

Moreover, a sliding block 350 is engaged with the guide rails 330 to be moved along the longitudinal direction by the worker in order to set the proper position. The sliding block 350 includes a sliding frame 352 for assembling the required parts and a slider 354 formed in the lower side of the sliding frame 352 which is mounted to slide in the recessed lateral surfaces (336).

The sliding block (350) comprises a pair of sliders (354) located underneath the sliding block (350) for mounting and sliding on the pair of guide rails (330), a pair of right and left pushing taps (362, 370) forming a cylindrical pocket (368) for inserting a spring (360) and an integrally formed extended leg (366) with pawls (364) below the pocket (368) for latching or unlatching to the rack gear teeth (334), a pair of right and left compartments (356, 358) for installing the right and left pushing taps (362, 370), respectively, and a controlling plate (380) for enveloping the sliding block (350) to fixedly install the right and left pushing taps (362, 370) into the right and the left compartments (356, 358), respectively.

The controlling plate (380) comprises a cutout (382) formed with a rectangular shape at the center of the controlling plate (380) for snapping into a rectangular detent (372) formed rectangular shape in the center the sliding block (350), and a pair of mounting feet (384) formed at the rear of the controlling plate (380) for snapping into the rear of the sliding block (350).

Thus, the right pushing taps 362 and the spring 360 are assembled to the sliding frame 352 and the controlling plate 380 covers the upper side of the sliding frame 352.

When the right pushing tap 362 is pushed in the opposite direction, the spring 360 is compressed and the pawls 364 formed in the foot of the right pushing taps 362 are disengaged from the rack gear teeth 334 of the guide rails 330.

As shown in FIG. 13*b*, when the sliding frame 352 is moved to the proper distance corresponding to the panel width of the shingle material, then the external force is released. As soon as the external force is released, the right pushing tap 362 returns back to the opposite direction due to the restoring force of the spring 360 so that the pawls 364 are engaged to the rack gear teeth 334 of the guide rails 330.

Then, the intervals are set between the muzzle 114 and the controlling plate 380 for nailing the waterproof sheets to attach to the roof at regular intervals.

Since the intervals between the muzzle 114 and the controlling plate 380 are controlled by moving the sliding block 350, the muzzle 114 is able to be positioned at the proper spots to nail. Thus, a measuring tape is not necessary to measure the nailing spot of the waterproof sheets while holding the heavy coil nailing device 100 with both hands.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

As described above, according to the coil nailer for construction finish materials of the present invention, since the door latch releases in the same direction as the opening direction of the door, the door latch is released when the door is opened so that the door can be conveniently opened. Since the operating direction of the door latch is perpendicular to the direction of recoil, the door cannot be opened due to the recoil.

Moreover, since the plate for supporting the nails in the magazine according to the length of the nails in the magazine is lowered or lifted according to the length of the nails, the nails can be effectively guided regardless of their length. In addition, the shingle interval setting device allows the interval between a lower waterproof sheet and an upper waterproof sheet to be easily controlled when attaching shingles and waterproof sheets. Since a measuring device capable of adjusting the shingle position is installed in the lower side of the magazine, a scale does not need to be used, so that use of the coil nailer can be simplified and a worker can freely fasten using both hands.

Additionally, according to the present invention, the contactor for preventing the contacting portion of the muzzle on the front side of the coil nailer from being worn can be securely and easily coupled without bolting or welding, and the coupling and the separation are very convenient so that the replacement of the contactor is easy.

What is claimed is:

1. A coil nailing device for construction finishing materials having a main body enclosing a set of pneumatic mechanisms for striking nails, a nose located in front of the main body for ejecting the nails, a handle grip, a trigger and a cylindrical magazine for supplying the nails, the coil nailing device comprising:

a standby part (112) for temporarily retaining and loading the nails or staples that are supplied from the cylindrical magazine, a door (132) installed adjacent to said standby part (112) for checking the status of the nails or staples, said door (132) hinged by a door shaft (136), a door latch (134) having a hook (142), a coil spring (140) and a latch hinge shaft (138), said door latch (134) hinged by the latch hinge shaft (138) and installed on the opposite end of the door from the door shaft (136) for locking the door (132), a muzzle (114) having an adapter (200), which forms a cubic-shaped block with an inner cavity (206) for inserting the nose (202), a foot plate (208) for contacting a work piece, and a pair of arced grooves (210) oppositely disposed on outer lateral surfaces of the muzzle, and a lever arm (212), which forms a flat bar-shaped handle integrally attached perpendicular to a pair of arced sliders (204) with a quarter circular sectors at a bottom end portion of the handle for rotationally sliding along with the arced grooves (210), so that said adapter (200) is easily attached to or removed from the nose (202) of the main body (104), a clearance setting device for loading various sizes of nails or staples by setting a container depth of the cylindrical magazine (110) having a central post (302) formed as a cylindrical-shaped tube integrally installed on an inner center of the cylindrical magazine (110), wherein said central post (302) has a first groove (318) with a first step retainer, a second groove (320) with a second step retainer, a third groove (322) and a pair of guide grooves (316*a*, 316*b*), which are formed on an outer circumferential surface along with an axial direction for properly setting and retaining the clearance or depth depending on the length of loaded nails or staples, so that various sized nails or staples can be properly loaded in a container of the cylindrical magazine (110) and can be properly guided and supplied to the muzzle (114), wherein said clearance setting device further consists of a disk plate (306) for properly retaining the loaded nails or staples in the cylindrical magazine (110), a sleeve (304) integrally mounted in the center of the disk plate (306) for inserting the central post (302), and said sleeve (304) further consisting a pair of semi-cylindrical protrusions (326) at the proximal end of its inner surface for inserting through the guide grooves (316*a*, 316*b*) and seating on either one of the first, second or third stepped grooves of said central post (302), and an interval setting device for nailing a series of shingle panels by setting a panel width or interval between neighboring shingle panels having a base (332) integrally installed, a pair of guiding rails (330), sliding block (350), controlling plate (380) and pushing taps (362, 370), of which structures are symmetrical with respect to a center line of the cylindrical magazine (110), so that the coil nailing device is easily maneuvered to slide along the side edge of the shingle panels for nailing or stapling.

2. The coil nailing device as set forth in claim 1, wherein said coil spring (140) is mounted on said latch hinge shaft (138) for exerting a resilient force on said door latch (134), so that said door (132) is prevented from accidental opening due to the repulsive force of a firing.

3. The coil nailing device as set forth in claim 1, wherein said latch hinge shaft (138) and said door shaft (136) are aligned with an axis of the main body (104), so that the door (132) and the door latch (134) are operated in the lateral direction, which is perpendicular to an axis of the main body (104).

4. The coil nailing device as set forth in claim 1, wherein said sleeve (304) further comprises a spring (308) for exerting a resilient force on the disk plate (306), a fastener bolt (312) for fastening the disk plate (306) onto the bottom of the cylindrical magazine (110), and a seal (310) and cap (314) for securing the disk plate (306).

5. The coil nailing device as set forth in claim 1, wherein said base (332) is attached under the cylindrical magazine (110) and said guiding rails (330) forms a series of rack gears (334) and recessed lateral surfaces (336), said guiding rails is symmetrically structured for mounting said sliding block (350).

6. The coil nailing device as set forth in claim 5, wherein said sliding block (350) further comprises a pair of sliders (354) located underneath the sliding block (350) for mounting and sliding on the pair of guiding rails (330), said pushing taps comprises of a pair of right and left pushing taps (362, 370) forming a cylindrical pocket (368) for inserting a spring (360) and an integrally formed extended leg (366) with pawls (364) below the cylindrical pocket (368) for latching or unlatching to the rack gear teeth (334), a pair of right and left compartments (356, 358) for installing the right and left pushing taps (362, 370), respectively, and the controlling plate (380) for enveloping the sliding block (350) to fixedly install the right and the left pushing taps (362, 370) into the right and the left compartments (356, 358), respectively.

7. The coil nailing device as set forth in claim 6, wherein said controlling plate (380) further comprises a rectangular cutout (382) in the center of the controlling plate (380) to snap into a rectangular detent (372) in the center of the sliding block (350), and a pair of mounting feet (384) formed at the rear of the controlling plate (380) to snap into the rear of the sliding block (350).

* * * * *